United States Patent [19]

Merritt

[11] Patent Number: 4,554,972

[45] Date of Patent: Nov. 26, 1985

[54] WELL TOOL LOCKING DEVICE

[75] Inventor: David T. Merritt, Celina, Tex.

[73] Assignee: Otis Engineering Corporation, Dallas, Tex.

[21] Appl. No.: 605,215

[22] Filed: Apr. 30, 1984

[51] Int. Cl.[4] ..... E21B 23/02

[52] U.S. Cl. ..... 166/137; 166/214

[58] Field of Search ..... 166/136, 137, 214–217, 166/237; 294/86.18; 285/3

[56] References Cited

U.S. PATENT DOCUMENTS

| | | | |
|---|---|---|---|
| 2,679,903 | 6/1954 | McGowen, Jr. et al. | 166/214 X |
| 3,074,485 | 1/1963 | McGowen, Jr. | 166/214 X |
| 3,088,521 | 5/1963 | Graves | 166/214 |
| 3,208,531 | 9/1965 | Tamplen | 166/136 X |
| 3,356,389 | 12/1967 | Fredd | 285/3 |
| 3,741,601 | 6/1973 | Dudley | 294/86.18 |
| 3,827,493 | 8/1974 | Terral | 166/215 |
| 3,863,961 | 2/1975 | Dinning | 166/215 X |
| 3,874,447 | 4/1975 | McGowen, Jr. | 166/214 |
| 4,265,306 | 5/1981 | Stout | 166/214 X |
| 4,294,313 | 10/1981 | Schwegman | 166/117.5 |
| 4,379,488 | 4/1983 | Hamm | 166/137 X |

*Primary Examiner*—Stephen J. Novosad
*Assistant Examiner*—Thuy M. Bui
*Attorney, Agent, or Firm*—Albert W. Carroll

[57] ABSTRACT

A latch for releasably anchoring well tools such as gas lift valves, or the like, in receptacles in well conduits, the latch becoming automatically locked in the receptacle upon reaching its proper position therein.

8 Claims, 3 Drawing Figures

WELL TOOL LOCKING DEVICE

BACKGROUND OF THE INVENTION

1. Field of the Invention

This invention relates to well tools and more particularly to devices for releasably anchoring well tools in well conduits.

2. Description of the Prior Art

Generally, gas lift valves and closely related devices of the retrievable type are releasably anchored in position in the receptacles of gas lift wells through use of locking devices known in the industry as gas lift latches. Many such latches have been designed and patented. Some of these latches are of the type which lock or latch automatically upon being inserted in their downhole receptacle. Examples of this last type of latch are found in the following U.S. patents with the exception of U.S. Pat. Nos. 3,208,531 and 4,294,313.

| | | | |
|---|---|---|---|
| 2,679,903 | 3,208,531 | 3,827,493 | 4,265,306 |
| 3,074,487 | 3,356,389 | 3,863,961 | 4,294,313 |
| 3,088,521 | 3,741,601 | 3,874,447 | |

U.S. Pat. No. 2,679,903 issued June 1, 1954 to H. E. McGowen, Jr. et al and discloses a latch member pivotally mounted in a housing and spring biased toward locking position. It can be unlocked only by shearing a pin and lifting a core member out of the way to permit the latch to rotate to unlocked position. The rotating latch member is disk-like and is thin, thus unable to withstand great loads.

U.S. Pat. No. 3,074,485 issued Jan. 22, 1963 to Harold E. McGowen, Jr. and discloses a latch having a ring which is spring biased toward its lower concentric, locked position, but can move upwardly and then to an eccentric position to move past a 180-degree locking shoulder under which the ring will assume a concentric locked position. This latch is not for use in receptacles having 360-degree lock shoulders.

U.S. Pat. No. 3,088,521 issued May 7, 1963 to Shelby J. Graves and discloses a latch device having a body with a blind bore in the side thereof in which a spring-loaded lock plunger is disposed. A spring-loaded core, when depressed, will permit the plunger to retract and enter a receptacle. The plunger then springs outwardly to locked position, after which the core is spring-pressed upwardly into locking position. Depressing the core and holding it depressed will permit the latch device to be withdrawn from its receptacle.

U.S. Pat. No. 3,208,531 issued to Jack W. Tamplen on Sept. 28, 1965. This patent discloses a locking device provided with keys which are retracted while the device is being lowered in a well but after it is stopped below a selected one of a plurality of receptacles and lifted therethrough, its running tool shifts an expander sleeve to an intermediate position to cause a spring to press the keys outwardly. Now, when the device is lowered into the receptacle, the keys will engage therein, and the running tool is then used to force the expander sleeve to a position locking the keys against inward movement.

U.S. Pat. No. 3,356,389 issued Dec. 5, 1967 to John V. Fredd and discloses a locking device employing a pair of C-rings on a body. A finger having broad and narrow regions is disposed in the gaps of the rings. Upon inserting the device in the receptacle, the lower ring, due to its drag, is moved upwardly to a narrow region on the finger and is able to contract and move past the lock shoulder. The upper ring, in the same manner, moves up to a broad region of the finger and, because it cannot contract, will stop the device in proper position. When the device is lifted, the lower ring will return to a broad region of the finger where, because it cannot contract, it will lock the device in the receptacle. Shearing a pin and lifting the finger will permit the device to be withdrawn from the receptacle.

U.S. Pat. No. 3,741,601 issued to William Aaron Dudley on June 26, 1973 and discloses a latch having a fixed core, a sleeve slidably mounted thereabout and pinned in its lower position thereon, and a collet surrounds the sleeve and is slidable longitudinally thereon. The collet can move upward upon encountering the receptacle. In its upper position, its fingers can move inwardly into a recess of the sleeve to move past the lock shoulder of the receptacle. Then the collet fingers spring outwardly therebelow. Upward movement of the device in the receptacle will cause the collet to move down to locked position. The latch is released by shearing a pin and lifting the sleeve so that the collet fingers can retract below it.

U.S. Pat. No. 3,827,493 issued to Ben D. Terral on Aug. 6, 1974 and discloses a ring-type latch device almost identical to that disclosed in U.S. Pat. No. 3,074,485, supra, and operates and functions in the same manner.

U.S. Pat. No. 3,863,961 issued to Robert W. Dinning on Feb. 4, 1975 and discloses a latch device having a fixed core, an expander sleeve is slidably mounted on the core and pinned in its lower position. A cage surrounds the sleeve and is movable longitudinally relative thereto. The cage carries locking lugs in windows formed therein and is spring pressed downwardly. The sleeve holds the locking lugs expanded. The cage is movable upwardly to a position wherein the lugs may retract into a recess of the sleeve. Thus, the latch can be inserted into a receptacle where it latches immediately. The latch is released by shearing the pin and lifting the sleeve from behind the lugs.

U.S. Pat. No. 3,874,447 issued to Harold E. McGowen, Jr. on Apr. 1, 1975 and discloses a collet-type latch device which is identical to that disclosed in U.S. Pat. No. 3,741,601, supra, except for the fact that its collet is a closed collet.

U.S. Pat. No. 4,265,306 issued May 5, 1981 to Gregg W. Stout and discloses a latch device which includes a core fixed to a cage having elongated windows with lugs disposed therein, an expander sleeve is disposed between the core and the cage and slidable relative to them, while a spring biases the lugs downward in the cage windows. The sleeve is pinned in its lower position. In this position, it holds the lugs expanded when they are in their lower position. The lugs are movable upwardly in the elongated windows to a level at which they can retract into a recess of the sleeve until they get past the lock shoulder in the receptacle. They immediately afterwards snap into locked position beneath the lock shoulder. Release of the tool is accomplished by shearing the pin and lifting the expander sleeve to permit the lugs to retract therebelow.

U.S. Pat. No. 4,294,313, which issued to Harry E. Schwegman on Oct. 13, 1981, discloses a slightly different type of latch in that this latch does not latch in its receptacle automatically, yet it is similar to the device of the present invention. The Schwegman latch 47, shown attached in the kickover tool of FIG. 12 of U.S. Pat. No. 294,313, comprises a tubular body 49 having windows in which lugs are disposed. A prong or expander 69 is pinned in its upper position allowing the lugs to retract for insertion in the receptacle. A no-go shoulder on the body limits downward movement of the body after which a pin 51 is sheared and the expander is moved down to expand the lugs to locking position. Lifting the expander releases the latch.

The present invention overcomes the problems associated with the prior art devices by providing a locking device for well tools, which is simple, economical, reliable, and can be run in latched condition and snapped into locking engagement in its downhole receptable. It is also able to withstand great axial loads as a result of great pressure differentials acting thereon. The lugs provide adequate bearing area to support such great loads. Installation and removal of the latch device are simple and easily accomplished.

SUMMARY OF THE INVENTION

The present invention is directed to locking devices for well tools having a tubular housing having windows in the wall thereof; lugs in the windows movable radially between retracted and expanded positions while at the same time being movable longitudinally between upper and lower positions; a core in the tubular housing movable between a lower position, in which an enlargement thereon supports the lugs against movement from expanded position, and an upper releasing position, in which the lugs can retract below the enlargement; and a spring yieldably biasing the lugs downward yet allowing them to move upward in the windows to a position wherein they can retract above the core enlargement to permit them to move downwardly past obstructions, such as the lock shoulder in the downhole receptacle.

It is therefore one object of this invention to provide a locking device for anchoring a well tool in a downhole receptacle in locked and sealed relation therewith.

Another object is to provide such a locking device which will lock automatically upon entering the device and reaching its proper position therein.

Another object of this invention is to provide a locking device which is simple in construction, has few parts, is economical, and is simple to install and remove from its receptable in a well conduit.

Another object is to provide a locking device having improved bearing area and load distribution to better enable the device to withstand increased axial forces tending to lift it from its locked position in the receptacle.

Another object is to provide a device of the character described which after it is snapped into locked position in its receptacle can be released only after shearing its shear pin.

Other objects and advantages will become apparent from reading the description which follows and from studying the accompanying drawing wherein:

DESCRIPTION OF THE PREFERRED EMBODIMENT

Figure 1:
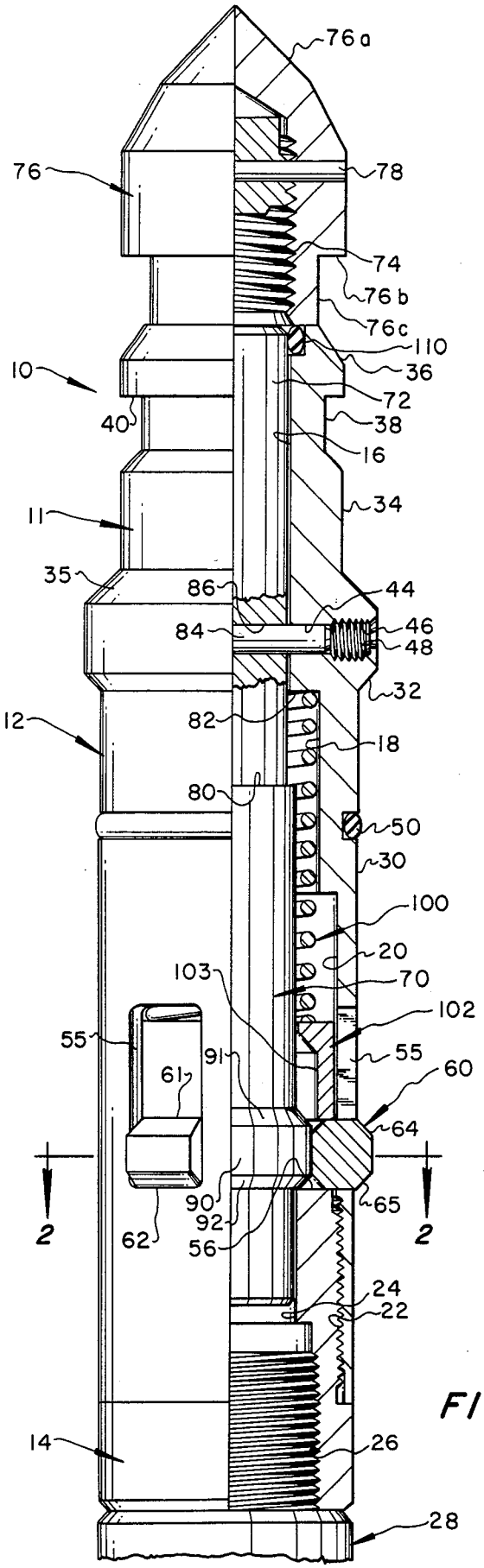
FIG. 1 is a longitudinal view, partly in section and partly in elevation, showing a locking device constructed in accordance with this invention and attached to the upper end of a well tool.

Referring now to FIG. 1, the locking device of this invention is seen to be indicated generally by the reference numeral 10. Device 10 comprises a housing 12 which includes an upper housing 11 and an adaptor or lower housing 14. The upper housing 11 is provided with a central bore 16 which is enlarged as at 18 and further enlarged as at 20, and the lower end thereof is internally threaded as at 22 for attachment of the lower housing 14. The lower housing 14 is provided with a central bore 24 which is enlarged and internally threaded as at 26 for attachment of a well tool such as well tool 28. Well tool 28 may be any suitable well tool such as a gas lift valve, a dummy gas lift valve, plug, check valve, or the like.

The upper housing 11 has its lower portion reduced in outside diameter as at 30 providing a downwardly facing inclined no-go shoulder 32. Shoulder 32 limits downward movement of the device 10 in its receptacle (not shown). The upper portion of the upper housing 11 is reduced in outside diameter as at 34, providing an upwardly facing shoulder 35, and its upper end is chamfered as at 36 to provide a guide surface. Spaced below chamfer 36 is an external annular recess 38 providing an abrupt downwardly facing shoulder 40 which is engageable by a suitable running tool. Such running tool will be guided into position by the chamfer 36 just mentioned.

Upper housing 11 is provided with a transverse shear pin hole 44 having its outer ends threaded as at 46 to accept screws such as screw 48. If desired, a resilient seal ring such as the O-ring 50 may be placed in a suitable external annular recess as shown.

The upper housing 11 is provided with a plurality of lateral windows 55 whose lower ends are preferably even with the upper end face 56 of the lower housing 14 as shown in FIG. 1. These windows are elongated and extend upwardly for a considerable distance. A locking lug 60 having upper and lower faces 61 and 62, respectively, is disposed in each of the windows 55 and is movable therein between an outer locking position shown in FIG. 2 and an inner releasing position shown in FIG. 3. Thus the locking lugs are movable between expanded and retracted positions. The locking lugs 60 may also be moved upwardly in the windows 55 from their lower position shown in FIG. 1. Each lug is provided with lateral ears 63 for limiting their outward movement to their locking position shown in FIGS. 1 and 2. The lugs 60 have their external upper and lower corners chamfered to provide upper and lower guide surfaces as at 64 and 65 to guide the lugs past obstructions as the device is moved through the well conduit and to cam the lugs inwardly as required.

Figure 2:
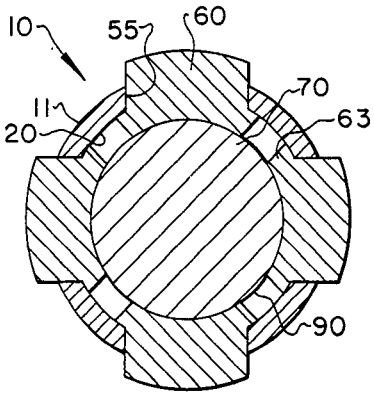
FIG. 2 is a cross-sectional view taken along line 2—2 of FIG. 1 showing the locking lugs in their expanded position.

A core 70 has its upper portion reduced in outside diameter as at 72 and externally threaded at its upper end as at 74 to receive a fishing neck 76 which is screwed thereon, and this screw connection is secured by a pin 78 which is placed in aligned apertures in the core and in the fishing neck. The reduced diameter 72 of the core provides an upwardly facing shoulder 80 which is engageable with downwardly facing shoulder 82 provided in the upper housing by the enlarged bore 18. The core 70 is thus movable from its lower position shown in FIG. 1 in which the lower end of the fishing neck 76 engages the upper end of the upper housing 11 and an upper position in which the upwardly facing shoulder 80 of the core engages or almost engages the downwardly facing shoulder 82 of the upper housing. A frangible shear pin 84 may be disposed in shear pin hole 86 of the core with at least one and preferably both of its ends disposed in the shear pin hole 44 of the upper housing. Screws 48 may be installed in the thread 46 of the shear pin hole to retain the shear pin. The shear pin 84 maintains the core in its lower position relative to the housing, as shown. The core is provided with an external flange or enlargement 90 whose upper and lower corners are beveled as at 91 and 92. When the core is in its lower position as shown in FIG. 1, this enlargement 90 is positioned on a level with the locking lugs 60 and supports them in their expanded position as shown in FIGS. 1 and 2.

A coil spring 100 surrounds the core and is disposed within the upper housing 11 as shown. The upper end of the spring bears against the downwardly facing shoulder 82 of enlarged bore 18 of the housing, and the lower end of the spring bears downwardly upon the upper end of ring 102 which, in turn, bears downwardly against the upper face 61 of the locking lugs 60. The purpose of the ring is to cause them to act in unison and to maintain the lugs in proper untilted position. Thus, the lugs are spring pressed toward their lower positions shown in FIG. 1.

Figure 3:
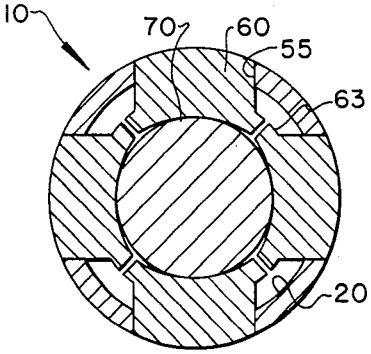
FIG. 3 is a cross-sectional view similar to that of FIG. 2 but showing the locking lugs in their retracted position.

Ring 102 is preferably formed with at least the lower portion of its bore 103 of sufficient diameter to loosely receive the enlargement 90 of the core when the core is lifted to allow the lugs to move to retracted position, as seen in FIG. 3. Thus, the spring 100 will apply a constant downward bias to the lugs even when the core is in its uppermost position.

The upper end of the ring 102 should provide a good support surface for the lower end of spring 100. If necessary, a flat washer (not shown) could be placed between the spring and the ring to provide such support surface.

Device 10 is run into a well on a suitable running tool carried on a suitable tool string. A suitable running tool is the Otis Type B Running Tool available from Otis Engineering Corporation, Dallas, Tex. This running tool has a downwardly opening socket for receiving the upper end of device 10. Its lower end would rest atop upwardly facing shoulder 35 and one or more shear pins would engage the device 10 as, for instance, just beneath the downwardly facing shoulder 40. The shear pins will thus releasably secure the device to the running tool.

When the locking device 10 is being lowered into a well and the lugs meet with an obstruction such as the locking shoulder near the upper end of a locking recess in the landing receptacle in which the device is to be installed, the downward movement of the lugs relative to the receptacle will be momentarily arrested while the locking device continues to move downwardly relative thereto. Downward forces may be applied to device 10 by the tool string without damaging the shear pins since these forces are applied to upwardly facing shoulder 35 and not to the shear pins. When the device has been lowered to such extent that the enlargement 90 of the core has moved below the locking lugs, the beveled or chamfered surface 65 at the lower corner of the dogs will cause the dogs to be cammed inwardly, thus retracting them into the housing above the enlargement 90 of the core and to the position as shown in FIG. 3. With the lugs thus retracted, the device may be lowered past the obstruction. As soon as the obstruction has been passed, the spring 100 maintaining a downward bias upward on the lugs through the ring 102 will force the lugs 60 to return to their lowermost position seen in FIG. 1.

Thus, the locking device is lowered in the well conduit sufficiently to encounter the upper end of the locking receptacle, the device will move downwardly therein, and the lugs will be moved upwardly relative thereto and will be retracted as just explained. As soon as the lugs get past the locking shoulder of the landing receptacle, the spring will return the lugs to their lower expanded positions seen in FIG. 1 to lock the device in the landing receptacle. The well tool 28 is thus installed in the landing receptacle and is locked securely in place with the enlargement 90 of the core holding the lugs 60 expanded into engagement below the locking shoulder of the landing receptacle. In addition, the O-ring 50 seals between the upper housing 11 and the bore of the receptacle. Downward movement of the device into the receptacle is limited by engagement of the downwardly facing shoulder 32 of the upper housing with the upper end of the receptacle. After device 10 has been locked in its receptacle, upward forces are applied to the running tool to lift it and engage chamfer 64 of the lugs 60 with the downwardly facing lock shoulder of the receptacle. Continued upward force will cause the shear pins to fail and the running tool to be lifted off the device 10, after which the tool train may be withdrawn from the well.

Should pressure differentials develop that would tend to lift the locking device and the well tools 28 out of the receptacle, the locking lugs will engage the downwardly facing locking shoulder of the receptacle and the upward thrust will be transmitted from the device to the receptacle through the lugs 60 by virtue of the contact of their lower face 62 with the lower side of the windows 55 (this includes the upper end face 56 of the lower housing 14) and their contact with the downwardly facing locking shoulder of the landing receptacle.

While the resilient seal ring 50 seals between the device and the receptacle, it is also necessary to provide means for sealing between the core and the upper housing. For this reason, a suitable resilient seal ring such as the O-ring 110 is placed in a suitable recess at or near the upper end of the upper housing 11. It is seen that O-ring 110 is disposed in a recess formed by enlarging bore 16 of upper housing 11. Here, O-ring 110 is obviously retained in place by the lower end face of the running neck which is in contact with or in close proximity to the upper end of the upper housing 11. Alternatively, the O-ring 110 could be placed in a conventional internal annular recess spaced below the upper end of the upper housing 11.

To remove the locking device 10 and the well tool 28 from tne landing receptacle, a suitable pulling tool such as the Otis Type RB Pulling Tool, available from Otis Engineering Corporation, Dallas, Tex., is lowered into the well on a wire line and is guided over the upper end of the fishing neck 76 by the guide surface **76*a*. Dogs on the pulling tool will then engage the downwardly facing shoulder 76*b* provided by the reduced diameter 76*c* of the fishing neck. Upward jarring impacts are then applied through manipulation of the wire line tools to shear the pin 84 and move the core 70 to its uppermost position in which its upwardly facing shoulder 80 engages the downwardly facing shoulder 82 of the upper housing 11, thus bringing the enlargement 90 of the core to a position wherein it is at a higher level than the locking lugs 60. Addtional lifting force applied to the locking device will cause the locking device to move upwardly, and the upper guide surface 64 of the locking lugs will cause the lugs to be cammed inwardly below the enlargement 90 of the core to the position shown in FIG. 3**. In this position, the locking lugs can be moved past the locking shoulder of the landing receptacle and the device can be withdrawn from the well with ease.

Thus, it has been shown that a device has been provided which fulfills the objects set forth herein above. It is to be understood that the device disclosed hereinabove can be provided with any desired number of locking lugs and that the external seal ring 50 and the no-go shoulder 32 may be placed at any desired location thereon.

The foregoing description and drawings of the invention are explanatory and illustrative only, and various changes in sizes, shapes, materials, and arrangements of parts, as well as certain details of the illustrated construction, may be made within the scope of the appended claims without departing from the true spirit of the invention.

I claim:

1. A locking device for releasably locking a well tool in a receptacle in a well conduit, said receptacle having a bore with a locking recess providing a downwardly facing lock shoulder, said locking device comprising:

a. tubular housing means having means at its uppper end for attachment to a running tool and means at its lower end for attachment of a well tool, said housing means having window means intermediate its ends;

b. lug means in said window means movable between expanded locking and retracted released positions, said lugs being also movable between upper and lower positions in said window means;

c. core means having an enlarged diameter portion and slidably carried in said tubular housing means and movable between an initial lower position in which said enlarged diameter portion supports said lug means in expanded position and an upper position in which said lug means is permitted to move to retracted position, said lug means when in their upper position in said window means being above said enlarged diameter portion of said core means and able to be moved to retracted position, and d. means biasing said lug means to their lower positions in said window means.

2. The device of claim 1, including means for initially releasably securing said core means in its lower position in said tubular housing means.

3. The device of claim 2, wherein said means for securing said core means in its lower position in said tubular housing means is a shear pin disposed in a transverse hole in said core means and having at least one of its ends disposed in a lateral aperture in the wall of said tubular housing means, said shear pin being shearable to release said core means for movement to its upper position.

4. The device of claim 3 wherein said means for biasing said lug means to their lower position in said window means is a coil spring.

5. The device of claim 4 wherein a ring surrounds said core means in said housing means and rests upon said lug means, and said coil spring is supported upon said ring while the upper end of said coil spring bears upwardly against a downwardly facing shoulder formed in said housing means.

6. The device of claim 5 wherein the inside diameter of at least the lower portion of said ring is larger than the diameter of the enlargement on said core means whereby said enlargement will be received in the bore of said ring when said core means is moved to its upper position and said spring will apply a continuous bias to said lug means whatever the position of said core means in said housing means.

7. The device of claim 6, wherein said housing means is formed with an external downwardly facing shoulder for limiting downward movement of the device into a landing receptacle.

8. The device of claim 7 including resilient seal means carried on said tubular housing means for sealing between said housing means and said receptacle and between said housing means and said core means.

* * * * *